US005889369A

United States Patent [19]

Roy

[11] Patent Number: 5,889,369

[45] Date of Patent: Mar. 30, 1999

[54] INCANDESCENT LAMP HAVING A LIFETIME EXTENDED BY TWO RECTIFYING DIODES AND A RESISTOR

[76] Inventor: Gilles Roy, 255 Pierre Gasnier, Laprairie, Québec, Canada, J5R 2N2

[21] Appl. No.: 541,125

[22] Filed: Oct. 11, 1995

[30] Foreign Application Priority Data

Aug. 8, 1995 [CA] Canada ..... 2155623

[51] Int. Cl.[6] ..... H05B 37/00

[52] U.S. Cl. ..... 315/51; 315/71; 313/318.11

[58] Field of Search ..... 315/51, 200 R, 315/71; 313/113, 318.11, 318.12

[56] References Cited

U.S. PATENT DOCUMENTS

| | | | |
|---|---|---|---|
| 3,148,305 | 9/1964 | Pearson | 315/51 |
| 3,450,893 | 6/1969 | Munson | 307/146 |
| 3,823,339 | 7/1974 | Borneman et al. | 315/69 |
| 3,869,631 | 3/1975 | Anderson et al. | 313/217 |
| 3,963,956 | 6/1976 | Beining | 315/71 |
| 4,480,212 | 10/1984 | Monahan et al. | 315/71 |
| 4,629,943 | 12/1986 | Ponce | 315/200 R |
| 4,897,578 | 1/1990 | Goad | 315/71 |
| 5,030,890 | 7/1991 | Johnson | 315/208 |
| 5,126,634 | 6/1992 | Johnson | 315/71 |

FOREIGN PATENT DOCUMENTS

| | | |
|---|---|---|
| 54984 | 3/1993 | Japan . |

*Primary Examiner*—Don Wong
*Assistant Examiner*—David H. Vu
*Attorney, Agent, or Firm*—Eric Fincham

[57] ABSTRACT

To extend the lifetime of an incandescent lamp having a sealed glass envelope, an inert gas or gas mixture contained in the glass envelope, a tungsten filament mounted in the glass envelope, a hollow bulb screw or prefocus base mounted to the glass envelope, and first and second lead in wires for electrically connecting the tungsten filament to the base, a first rectifying diode is connected in series with the tungsten filament. Connected in parallel with the first rectifying diode is a series circuit including a resistor connected in series with a second rectifying diode. The first and second diodes are connected in opposite directions whereby the first rectifying diode applies to the filament the positive half-cycles of an alternating supply voltage, and the second rectifying diode applies to the tungsten filament the negative half-cycles attenuated by a voltage drop within the resistor.

7 Claims, 3 Drawing Sheets

INCANDESCENT LAMP HAVING A LIFETIME EXTENDED BY TWO RECTIFYING DIODES AND A RESISTOR

BACKGROUND OF THE INVENTION

1. Field of the Invention

The present invention relates to an incandescent lamp of which the lifetime is extended by supplying the tungsten filament of the lamp through two rectifying diodes and a resistor. More specifically, the present invention is concerned with, in particular but not exclusively, incandescent lamps of the type used in traffic signal lights and in high structure obstruction marking.

2. Brief Description of the Prior Art

Conventionally, A-line or PS-line gas filled incandescent lamps are used in traffic signal lights and in high structure obstruction marking. Such lamps are constructed to operate from an AC (alternating current) voltage having a nominal amplitude of 120 volts and a nominal frequency of 60 Hz, and have standard power ratings of 69, 90, 100, 105, 116, 620 or 700 watts. These prior art incandescent lamps, having an average lifetime of 5000 hours, may be termed short-lifetime lamps as compared with known incandescent lamps having extended lifetimes up to several years. Failure of these conventional incandescent lamps is mainly caused by evaporation of the tungsten of the filament, the rate of evaporation of the tungsten increasing with the temperature of operation of the filament.

To extend the lifetime of an incandescent lamp, U.S. Pat. No. 4,897,578 granted to Christopher F. Goad, Sr. on Jan. 30, 1990 uses a rectifying diode connected in series with the tungsten filament of the lamp. Incorporation of a rectifying diode in the structure of an incandescent lamp is further described in the following three United States patents:

| | | |
|---|---|---|
| 3,148,305 | Pearson | 1964 |
| 3,869,631 | Anderson et al. | 1975 |
| 4,480,212 | Monahan | 1984 |

The use of a rectifying diode installed in a socket for extending the lifetime of incandescent lamps is also disclosed in the following two United States patents:

| | | |
|---|---|---|
| 3,450,893 | Munson | 1969 |
| 3,963,956 | Beining | 1976 |

With a rectifying diode, only the positive or negative half-cycles of the AC voltage are applied across the filament. Consequently the effective voltage supplying the tungsten filament is substantially lowered, thus reducing the temperature of operation of the filament. For example, when no rectifying diode is connected in series with its tungsten filament, a standard above-mentioned incandescent lamp of 100 watts has an operating temperature of approximately 2590° C. and produces a light intensity of about 1070 lumens. With a rectifying diode connected in series with the tungsten filament, the operating temperature of the same lamp reduces to 2190° C., and the light intensity produced is approximately 375 lumens. Connection of a diode in series with the tungsten filament of an incandescent lamp reduces the power consumption of the lamp from 100 watts to 58.4 watts and increase its average operating lifetime from about 3000 hours to approximately 9.7 years.

However, connecting a rectifying diode in series with the tungsten filament of an incandescent lamp presents the drawback that the tungsten filament has a lower efficiency in terms of lumens per watt.

Another drawback of connecting a single rectifying diode in series with the filament of an incandescent lamp as taught in the above mentioned U.S. Pat. No. 4,897,578 (Christopher F. Goad, Sr.) issued on Jan. 30, 1990, is that the incandescent lamp is no longer compatible with the traffic signal light monitoring control systems and with the high structure obstruction marking light alarm systems presently in operation. Indeed, a traffic signal light monitoring control system indicates proper operation of a traffic signal lamp upon detection of both positive and negative half-cycles of an AC current flowing through the tungsten filament of this lamp. In the same manner, a high structure obstruction marking light alarm system must detect both positive and negative half-cycles of an AC current flowing through the tungsten filament, otherwise an alarm indicating a faulty marking lamp is produced. Accordingly, to prevent the traffic signal light monitoring control systems and the high structure obstruction marking light alarm systems presently in operation to generate a false indication of a faulty lamp, they have to detect both positive and negative half-cycles of an AC current flowing through the tungsten filament. The rectifying diode of the incandescent lamp of Goad prevents one of the positive of negative half-cycles from being supplied to the traffic signal light monitoring control systems and the high structure obstruction marking light alarm systems.

OBJECT OF THE INVENTION

Accordingly, an object of the present invention is to extend the lifetime of an incandescent lamp without affecting the compatibility of that lamp with the traffic signal light monitoring control systems and the high structure obstruction marking light alarm systems already in operation.

SUMMARY OF THE INVENTION

More particularly, in accordance with the present invention, there is provided a method for extending the lifetime of an incandescent lamp having an electric incandescent filament, comprising the steps of:

connecting in series with the filament a first rectifying diode, and connecting in parallel with the first rectifying diode a second rectifying diode serially connected with a resistor, wherein the first and second rectifying diodes are connected in opposite directions; and supplying an alternating voltage to the circuit including the filament, the first and second rectifying diodes and the resistor whereby voltage half-cycles of a first polarity are applied to the filament through the first rectifying diode, and voltage half-cycles of a second polarity attenuated by a voltage drop within the resistor are applied to the filament through the second rectifying diode.

The present invention also relates to an electric lighting circuit comprising (a) an incandescent lamp having an electric incandescent filament and (b) an alternating voltage supply source having two terminals for supplying the filament, the inprovement therein comprising a device for extending the lifetime of the incandescent lamp comprising:

a first rectifying diode connected in series with the filament between the two terminals of the source; and a series circuit connected in parallel with the first rectifying diode, the series circuit including a resistor connected in series with a second rectifying diode, wherein the first and second diodes are connected in opposite directions;

whereby, in operation, voltage half-cycles of a first polarity are applied to the filament through the first rectifying diode, and voltage half-cycles of a second polarity attenuated by a voltage drop within the resistor are applied to the filament through the second rectifying diode.

Further in accordance with the present invention, there is provided an incandescent lamp comprising (a) a sealed glass envelope, (b) an inert gas means contained in the glass envelope, (c) a tungsten filament mounted in the glass envelope and having first and second ends, (d) an electric connector unit mounted to the glass envelope and comprising first and second electric terminals insulated from each other, (e) a first lead in wire for electrically connecting the first terminal to the first end of the filament, and (f) a second lead in wire for electrically connecting the second terminal to the second end of the filament, in which the improvement comprises:

a first rectifying diode connected in series with the first lead in wire between the first terminal and the first end of the filament; and a series circuit connected in parallel with the first diode, the series circuit including a resistor connected in series with a second rectifying diode, wherein the first and second diodes are connected in opposite directions.

Again, when an alternating supply voltage is applied between the first and second terminals, voltage half-cycles of a first polarity are applied to the tungsten filament through the first rectifying diode, and voltage half-cycles of a second polarity attenuated by a voltage drop within the resistor are applied to the tungsten filament through the second rectifying diode.

In accordance with preferred embodiments of the invention:

the first and second rectifying diodes and the resistor are mounted outside the glass envelope of the lamp;

the electric connector unit comprises a hollow metal base in which the first and second rectifying diodes and the resistor are mounted; and the incandescent lamp further comprises a heat deflector positioned between (a) the tungsten filament and (b) the first diode, the second diode and the resistor, to deflect heat generated by the tungsten filament and prevent the deflected heat to reach the first diode, the second diode and the resistor.

The objects, advantages and other features of the present invention will become more apparent upon reading of the following non restrictive description of a preferred embodiment thereof, given by way of example only with reference to the accompanying drawings.

DETAILED DESCRIPTION OF THE PREFERRED EMBODIMENTS

Figure 1:
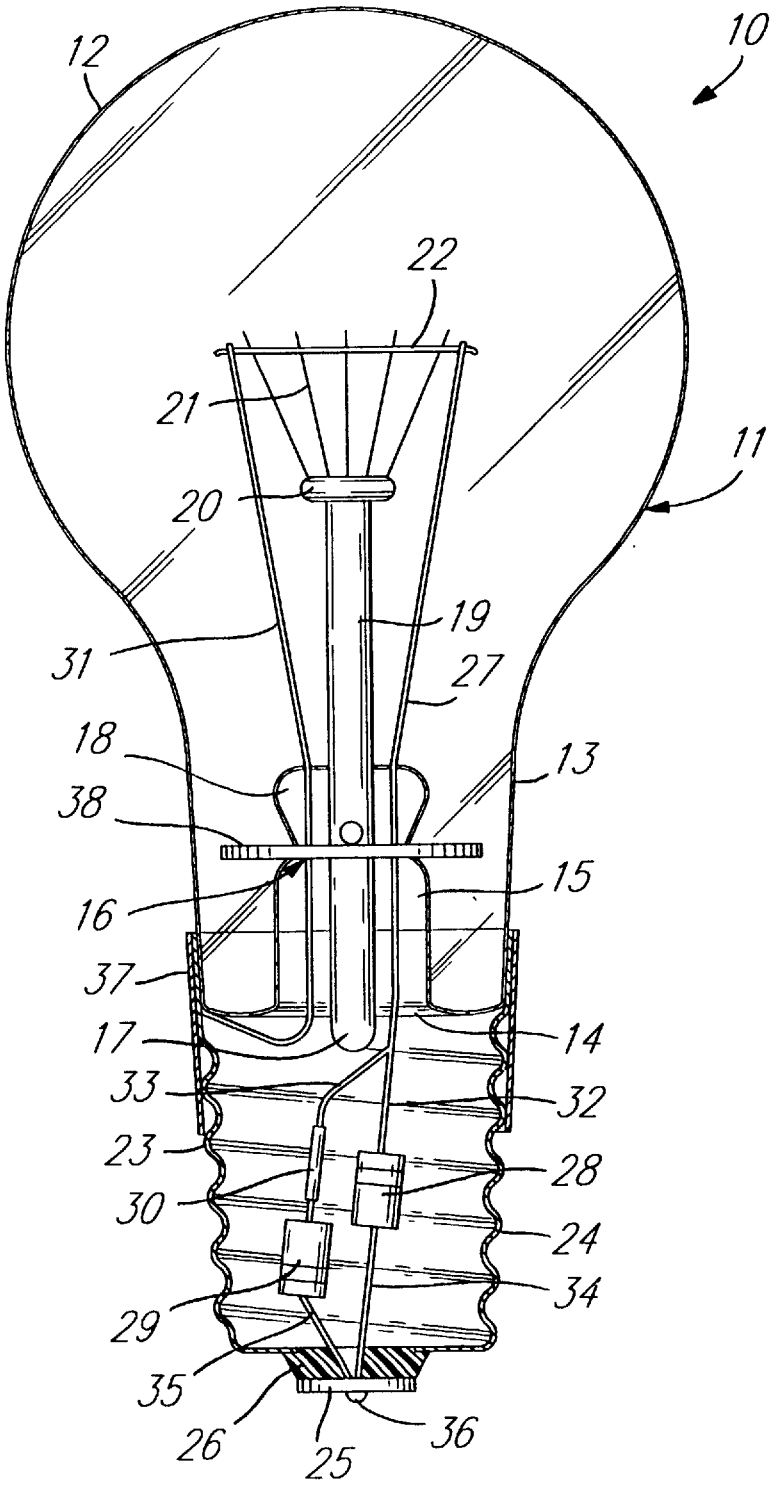
FIG. 1 is an elevational, partially cross sectional view of an A-line type incandescent lamp in accordance with the present invention, comprising a tungsten filament supplied with alternating current through two rectifying diodes and a resistor.

FIG. 1 of the appended drawings illustrates an incandescent lamp of A-line type generally identified by the reference 10.

The incandescent lamp 10 comprises an envelope 11, made of soft or hard glass. This glass envelope 11 is itself formed with a bulb portion 12, a neck portion 13 and a flare 14 defining a cavity 15 itself having a bottom 16.

Outside the envelope 11, an exhaust tube 17 extends from the bottom 16 through the cavity 15. As well known to those of ordinary skill in the art, the exhaust tube 17 is used to replace the air inside the glass envelope 11 by an appropriate inert gas of gas mixture such as a mixture of 75% to 95% krypton and 5% to 25% nitrogen, or 50% argon and 50% nitrogen.

Successively and axially extending from the bottom 16 of the cavity 15 inside the glass envelope 11 are a stem press 18, a stem 19 (arbour) and a button 20 forming a one piece glass support.

At least one metallic wire support such as 21 have a first end embedded in the glass material of the button 20, and a second end supporting a coil or coiled coil filament 22 made for example of tungsten. In the example illustrated in FIG. 1, five metallic wire supports 21 are provided.

A threaded metal sleeve 23 has one end conventionally secured to the flare 14 of the envelope 11. As illustrated in FIG. 1, the threaded metal sleeve 23 is generally coaxial to the envelope 11.

A conventional metallic bulb screw base 24 is welded to the free end of the threaded metal sleeve 23. As well known to those of ordinary skill in the art, the distal free end of the bulb screw base 24 of the incandescent lamp 10 conventionally comprises a circular center lead in wire surface contact 25 electrically insulated from the metallic material of bulb screw base 24 by means of a dielectric insulator 26.

Still referring to FIG. 1, the tungsten filament 22 comprises a first end connected to the center lead in wire surface contact 25 through a lead in wire 27 and a rectifying diode 28 connected in parallel with serially interconnected rectifying diode 29 and resistor 30. The tungsten filament also comprises a second end connected to the threaded metal sleeve 23 through a lead in wire 31. Of course, the diodes 28 and 29 and the resistor 30 are rated to withstand the wattage of the tungsten filament 22.

More specifically, the lead in wire 27 has a first end connected to the corresponding end of the tungsten filament 22 and a second end connected to the cathode wire 32 of the rectifying diode 28 and to a wire terminal 33 of the resistor 30. As shown, the lead in wire 27 extends from the corresponding end of the tungsten filament 22 through the stem press 18, the cavity bottom 16 and the cavity 15 to reach the cathode wire 32 of the rectifying diode 28 and the wire terminal 33 of the resistor 30. Regarding the anode wire 34 of the rectifying diode 28 and the cathode wire 35 of the rectifying diode 29, they extend through a hole (not shown) in the dielectric insulator 26 to be finally soldered to the center lead in wire surface contact 25 through a center lead in wire contact 36.

The lead in wire 31 has a first end connected to the corresponding end of the tungsten filament 22 and a second end connected, as indicated in the foregoing description, to the threaded metal sleeve 23. As shown, the lead in wire 31 extends from the corresponding end of the tungsten filament 22 through the stem press 18, the cavity bottom 16 and the cavity 15 to reach the outer surface of the threaded metal sleeve 23 to which it is soldered.

As can be seen, the function of the threaded metal sleeve 23 is to lengthen the bulb screw base 24 and thereby enable installation of the rectifying diodes 28 and 29 and the resistor 30 therein.

When the metallic bulb screw base 24 is screwed into an electric supply socket (not shown), the outer surface of the threaded metal sleeve 23 is exposed. To prevent electrical shock hazard, the outer surface of the metal sleeve 23 is covered by a tubular, high temperature insulation sleeve 37. The high temperature insulation sleeve 37 may be made, for example, of the heat-shrinkable tubing commercialized by the company 3M under the trade name VTN-200.

Finally, an annular heat deflector 38 is fitted and mounted around the base of the stem press 18 to deflect heat generated by the tungsten filament 22 and therefore prevent the deflected heat to reach the inside of the metal sleeve 23 and the bulb screw base 24 in which the rectifying diodes 28 and 29 and the resistor 30 are mounted. The rectifying diodes 28 and 29 and the resistor 30 are thereby better insulated from the heat produced by the tungsten filament 22.

When the metallic bulb screw base 24 is screwed into an electric supply socket (not shown), the filament 22 is supplied with alternating voltage and current through the center lead in wire surface contact 25, the center lead in wire contact 36, the circuit including the rectifying diodes 28 and 29 and the resistor 30, the lead in wire 27, the lead in wire 31, the metal sleeve 23 and the metallic bulb screw base 24.

Figure 2:
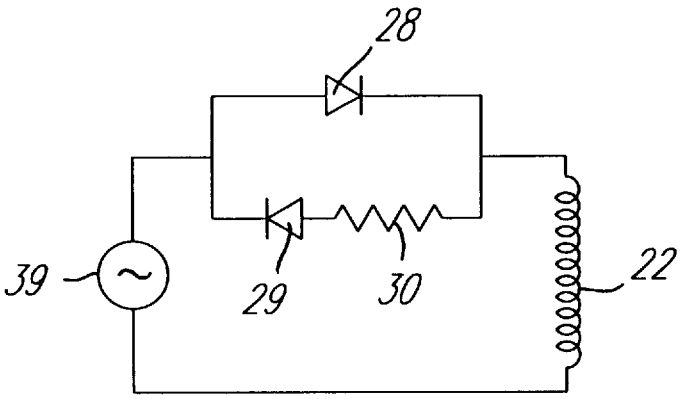
FIG. 2 is a schematic representation of the electric circuit in which the tungsten filament, the two rectifying diodes and the resistor of the incandescent lamp of FIG. 1 are interconnected.
Figure 3:
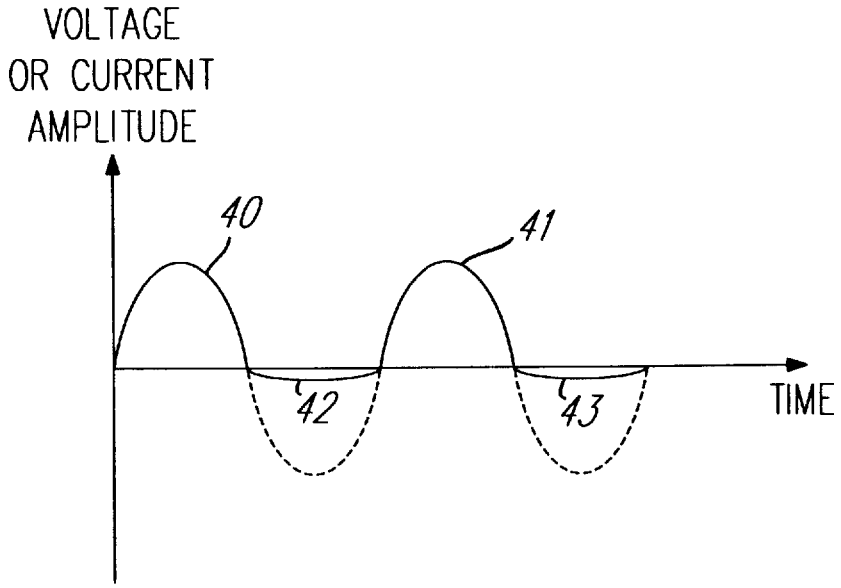
FIG. 3 is a schematic representation of the voltage and current waveform supplied to the tungsten filament of the incandescent lamp of FIG. 1.

Referring to FIGS. 2 and 3, it is shown that the positive half-cycles such as 40 and 41 (FIG. 3) of the alternating voltage and current from the source 39 (FIG. 2) are applied to the tungsten filament 22 through the rectifying diode 28. The resistance of the resistor 30 is selected to highly attenuate the amplitude of the negative half-cycles such as 42 and 43 (FIG. 3) of the alternating voltage and current across the tungsten filament 22 while enabling the traffic signal light monitoring control systems and the high structure obstruction marking light alarm systems already in operation to still detect these low amplitude voltage and current negative half-waves such as 42 and 43.

Those of ordinary skill in the art will appreciate that the low amplitude of the negative half-cycles such as 42 and 43 of the alternating current and voltage still enables manufacture of an incandescent lamp 10 of which the tungsten filament 22 has an extended lifetime. Also, the low amplitude voltage and current negative half-cycles such as 42 and 43 are still detectable by both the traffic signal light monitoring control systems and the high structure obstruction marking light alarm systems to thereby ensure proper operation of such systems as discussed in the foregoing description.

Finally, it should be pointed out that the power rating of the tungsten filament 22 can be increased in relation to the lower amplitude effective voltage applied to that tungsten filament to increase the produced light intensity. Of course, the resistance of the resistor 30 is then adjusted in relation to the electric resistance of the tungsten filament of higher power rating.

Figure 4:
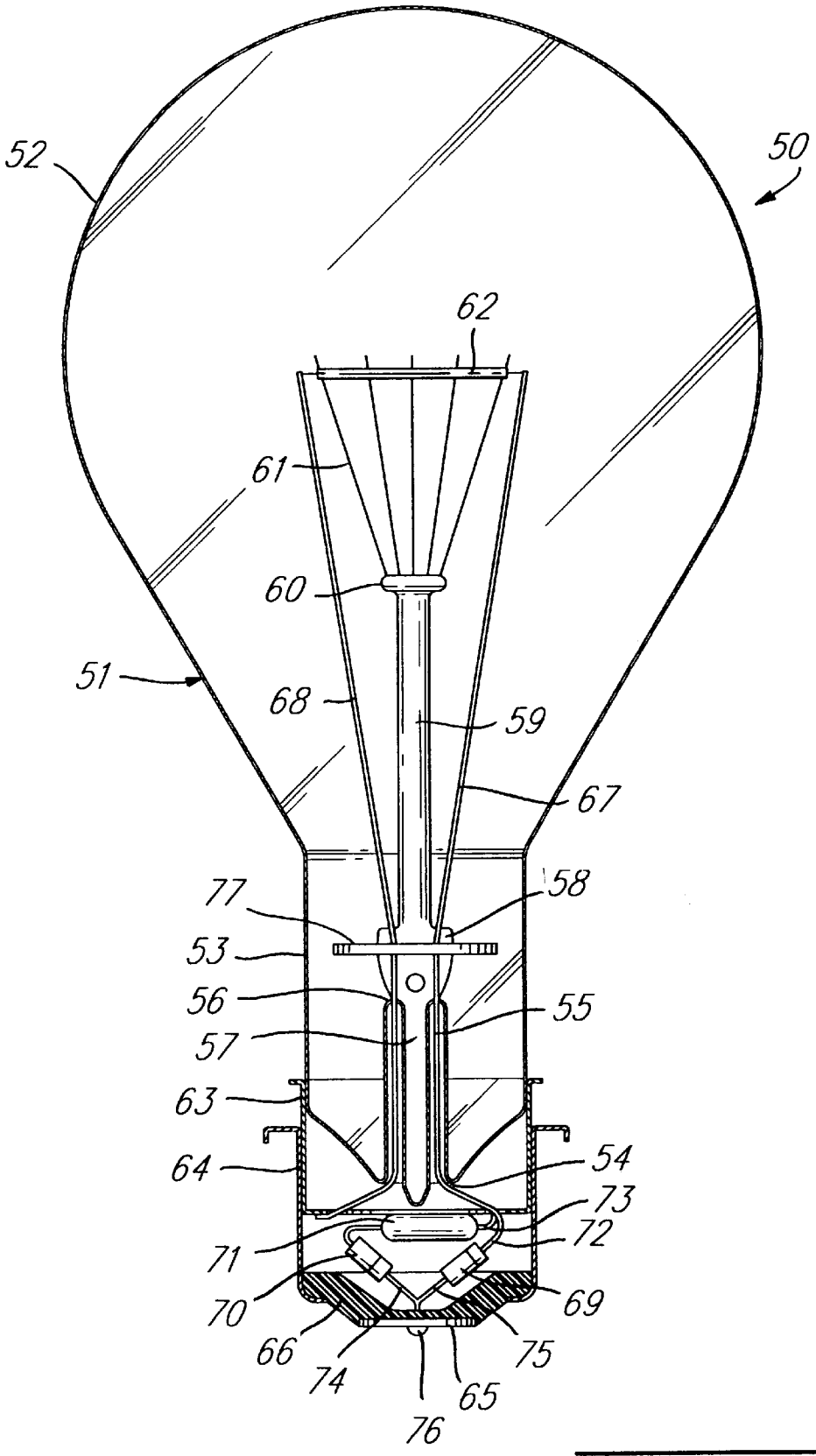
FIG. 4 is an elevational, partially cross sectional view of a PS-line type incandescent lamp in accordance with the present invention, comprising a tungsten filament supplied with alternating current through two rectifying diodes and a resistor.

FIG. 4 of the appended drawings illustrates an incandescent lamp of PS-line type generally identified by the reference 50. Like the above described A-line type lamp 10, the PS-line type lamp 50 comprises:

an envelope 51 made of soft or hard glass and formed with a bulb portion 52, a neck portion 53, a flare 54 itself defining a cavity 55, and an exhaust tube 57 extending outside the envelope 51 through the cavity 55 from the bottom 56 of this cavity 55;

a stem press 58, a stem 59 (arbour) and a button 60 successively and axially extending from the bottom 56 of the cavity 55 inside the glass envelope 51 to form a one piece glass support;

a coil or coiled coil filament 62 made for example of tungsten;

one to five (five in the illustrated example) metallic wire supports such as 61 each having a first end embedded in the glass material of the button 60, and a second end supporting the tungsten filament 62;

a first cylindrical metal base 63 having one end conventionally secured to the distal end of the neck portion 53 of the envelope 51;

a mogul prefocus cylindrical metal base 64 welded over the metal base 63 and provided with a distal free end comprising a circular center lead in wire surface contact 65 electrically insulated from the metallic material of the prefocus metal base 64 by means of a dielectric insulator 66;

a lead in wire 67 connected to a first end of the tungsten filament 62 and extending from that first end of the tungsten filament 62 through the stem press 58, the cavity bottom 56 and the cavity 55 to reach the inside of the prefocus metal base;

a second lead in wire 68 for connecting the second end of the tungsten filament 62 to the first metal base 63. As illustrated, the lead in wire 68 has a first end connected to the corresponding end of the tungsten filament 62 and a second end soldered to the first metal base 63. The lead in wire 68 extends from the corresponding end of the tungsten filament 62 through the stem press 58, the cavity bottom 56 and the cavity 55 to reach the inner surface of the first metal base 63;

a rectifying diode 69 connected in parallel with serially interconnected rectifying diode 70 and resistor 71. The cathode wire 72 of the rectifying diode 69 and the wire terminal 73 of the resistor 71 are connected to the adjacent end of the lead in wire 67. Regarding the anode wire 75 of the rectifying diode 69 and the cathode wire 74 of the rectifying diode 70, they extend through a hole (not shown) in the distal free end of the metal base 64 and a hole (not shown) in the dielectric insulator 66 to be finally soldered to the center lead in wire surface contact 65 through a center lead in wire contact 76; and an annular heat deflector 77 is fitted and mounted around the stem press 58 to deflect heat generated by the tungsten filament 62 and therefore prevent the deflected heat to reach the inside of the metal bases 63 and 64 in which the rectifying diodes 69 and 70 and the resistor 71 are mounted.

Operation of the incandescent lamp 50 of FIG. 4 is the same as described hereinabove with reference to the incandescent lamp 10.

Although the present invention has been described hereinabove with reference to preferred embodiments thereof, these embodiments may be modified at will, within the scope of the appended claims, without departing from the spirit and nature of the subject invention.

For example, it is not required that the circuit including the rectifying diode 28,69 connected in parallel with the serially interconnected resistor 30,71 and rectifying diode 29,70 be mounted in the metal base 24,64 of the lamp 10,50. It can be placed anywhere as long as this circuit is, as illustrated in FIG. 3, connected in series with the filament 22,62 between the two terminals of the alternating source 39.

What is claimed is:

1. A method for extending the lifetime of an incandescent lamp having an electric incandescent filament without affecting the compatibility of the incandescent lamp with traffic signal light monitoring control systems and high structure obstruction marking light alarm systems wherein the control and alarm systems monitor the presence of both positive and negative half-cycles, comprising the steps of:

connecting in series with the filament a first rectifying diode, and connecting in parallel with the first rectifying diode a second rectifying diode serially connected with a resistor, the first and second rectifying diodes being connected in opposite directions whereby voltage and current half-cycles of a first polarity are applied to the filament through the first rectifying diode and voltage and current half-cycles of a second polarity attenuated by a voltage drop within the resistor are applied to the filament through the second rectifying diode, the resistor having a resistance value to minimize the half-cycles of said second polarity while enabling the traffic signal light monitoring control systems and high structure obstruction marking light alarm systems to detect the voltage and current half-cycles of both first and second polarities supplied to the filament.

2. In a lighting arrangement having at least one incandescent lamp and a monitoring system for the incandescent lamp which monitors for the presence of both positive and negative voltage and current half-cycles, the improvement wherein said incandescent lamp comprises a sealed glass envelope, an inert gas contained in the glass envelope, a tungsten filament mounted in the glass envelope and having first and second ends, an electrical connector unit mounted to the glass envelope and having first and second electric terminals insulated from each other, a first lead in wire for electrically connecting said first terminal to said first end of the filament, a second lead in wire for electrically connecting said second terminal to said second end of the filament, a first rectifying diode connected in series with said first lead in wire between said first terminal and said first end of the filament, and a series circuit connected in parallel with the first diode, said series circuit including a resistor connected in series with a second rectifying diode, said first and second diodes being connected in opposite directions, the arrangement being such that when an alternating supply voltage is applied between said first and second terminals, voltage and current half-cycles of a first polarity are applied to the tungsten filament through the first rectifying diode, and voltage and current half-cycles of a second polarity are applied to the tungsten filament through the second rectifying diode, said resistor having a resistance value sufficient to lower substantially said half-cycle of said second polarity to a minimal value while permitting said monitoring system to detect said half-cycle of said second polarity.

3. An incandescent lamp according to claim 2, in which the first and second rectifying diodes and the resistor are mounted outside the glass envelope.

4. An incandescent lamp according to claim 3, in which the electric connector unit comprises a hollow metal base in which the first and second rectifying diodes and the resistor are mounted.

5. An incandescent lamp according to claim 4, further comprising a heat deflector mounted in the glass envelope between (a) the tungsten filament and (b) the first diode, the second diode and the resistor, to deflect heat generated by the tungsten filament and prevent the deflected heat from reaching the first diode, the second diode and the resistor.

6. An incandescent lamp according to claim 2, further comprising a heat deflector positioned between (a) the tungsten filament and (b) the first diode, the second diode and the resistor, to deflect heat generated by the tungsten filament and prevent the deflected heat from reaching the first diode, the second diode and the resistor.

7. In a lighting arrangement having at least one incandescent lamp and having an electric incandescent filament and alternating voltage supply source for supplying the filament and a monitoring system for the incandescent lamp which monitors for the presence of both positive and negative voltage and current half-cycles, the improvement comprising a circuit having a first lead in wire for electrically connecting a first one of said two terminals to a first end of said incandescent filament, a second lead in wire for electrically connecting a second one of said two terminals to a second end of said incandescent filament, a first rectifying diode connected in series with said first lead in wire between said first terminal and said first end of the filament, and a series circuit connected in parallel with the first diode, said series circuit including a resistor connected in series with a second rectifying diode, said first and second diodes being connected in opposite directions, the arrangement being such that when an alternating supply voltage is applied between said first and second terminals, voltage and current half-cycles of a first polarity are applied to the tungsten filament through the first rectifying diode, and voltage and current half-cycles of a second polarity are applied to the tungsten filament through the second rectifying diode, said resistor having a resistance value sufficient to lower substantially said half-cycle of said second polarity to a minimal value while permitting said monitoring system to detect said half-cycle of said second polarity.

* * * * *